United States Patent [19]

de Baan et al.

[11] Patent Number: 5,044,297

[45] Date of Patent: Sep. 3, 1991

[54] DISCONNECTABLE MOORING SYSTEM FOR DEEP WATER

[75] Inventors: Jacob de Baan, BH Maassluis, Netherlands; Willem Jan van Heijst, Villars-sur-Glane, Switzerland

[73] Assignee: Bluewater Terminal Systems N.V., Netherlands

[21] Appl. No.: 583,033

[22] Filed: Sep. 14, 1990

[51] Int. Cl.[5] ..... B63B 21/50

[52] U.S. Cl. ..... 114/293; 441/4

[58] Field of Search ..... 114/230, 293, 294; 441/3-5

[56] References Cited

U.S. PATENT DOCUMENTS

| | | | |
|---|---|---|---|
| 3,335,690 | 2/1966 | Busking | 114/230 |
| 4,509,448 | 4/1985 | Pease et al. | 114/293 |
| 4,604,961 | 8/1986 | Ortloff et al. | 114/230 |
| 4,650,431 | 3/1987 | Kentosh | 441/5 |
| 4,765,378 | 8/1988 | Engelskirchen et al. | 441/5 |

FOREIGN PATENT DOCUMENTS

| | | |
|---|---|---|
| 0059499 | 8/1982 | European Pat. Off. . |
| 2094738 | 9/1982 | United Kingdom . |

*Primary Examiner*—Jesus D. Sotelo

[57] ABSTRACT

A deep water mooring system including a connector element which is nonbuoyant, has connections to a submerged pipeline and which is supported by flotation tanks that are anchored to the bottom, and a device for retrieving the connector element from the water and to connect to a suitable floating surface storage system for flow between the storage system and the submerged pipeline. The retrieval line with a buoy holding its upper end at the surface coacts with the vessel in which the storage system is contained, or to which it is connected, for quick and easy retrieval and connection of the connector element to the vessel. Additionally, the retrieval line buoy may be provided with sufficient buoyancy capacity to provide an additional lift to the connector element and thus aid the flotation tanks in maintaining the connector element when not in use at a preselected depth in the water.

7 Claims, 5 Drawing Sheets

DISCONNECTABLE MOORING SYSTEM FOR DEEP WATER

BACKGROUND

The present system relates to a disconnectable mooring system for use in connection with dedicated storage tankers for the transfer of hydrocarbons and in areas where the tanker vessel needs to be disconnected in case of a typhoon or hurricane warnings or when endangered by icebergs.

Prior to the present invention, such systems included a buoyant connector element which is raised and connected to equipment on the tanker. Such mooring systems are known from European Patent Specification 0.059.499 and GB 2.094.738A. In these mooring systems the chains carrying connector body comprises a buoyancy compartment to keep the connector body near or at the surface of the water. In this structure the tanker engages the mooring system at its bow.

Another prior system is shown in U.S. Pat. No. 4,604,961 in which the mooring system includes a buoyant connector which is engaged within a recess through the hull of the floating vessel. The buoyancy of the connector or mooring element is selected so that when it is disconnected from the vessel it sinks to a depth which is spaced above the ocean floor.

In deeper water sites with severe weather conditions requiring heavy anchor chains, the buoyancy compartment must be large to keep the connector body near or on the surface. The practical experience in the application of these systems has shown that during the hook-up operation, whereby the buoyant connector body is slowly pulled up by the vessel, strong lateral swinging motions occur as a result of wave or current effects on this buoyant body. This effect is dependent on the tension force in the pull-in rope and, therefore, becomes more pronounced in deep water applications.

The present invention relates to a semi-permanent mooring system comprising a floating unit or vessel which could have storage capacity, such as a tanker, mooring legs, such as chains or cables, for anchoring the vessel, which legs are connected to a connector body which is rotatably secured about a vertical axis to the vessel and through which connector body conduits extend towards the vessel and into a rotatable pipeline coupling for one or more pipes which coupling is supported by the vessel whereby the connector body can be connected or released from the vessel if such is required for typhoon or iceberg warnings.

An object of the invention is to provide an improved mooring system in which the connector body is nonbuoyant and is supported in the water and is readily retrievable by a floating structure.

Another object of the present invention is to provide an improved mooring system of the type described in which the current and wave action on the connector body during retrieval are reduced.

As used herein, the term nonbuoyant is intended to mean that the connector body will not have sufficient buoyancy to float or to carry any portion of the mooring legs.

BRIEF DESCRIPTION OF THE DRAWINGS

These and other objects and advantages are hereinafter set forth and explained with reference to the drawings wherein.

DESCRIPTION OF THE PREFERRED EMBODIMENTS

The reduction in the response to current and wave movement during retrieval is obtained by separating the buoyancy part from the connector body and to incorporate the required buoyancy in the individual mooring legs or anchor chains away from the connector body. Preferably the connector body is kept in position by three cables or chains, or a combination thereof, spaced at 120° intervals, but the number can be increased if the excursions of the vessel needs to be restricted in all wind directions. The receiving part of the connector body can be located at either end of the vessel and above the water to a rigid frame as known from U.S. Pat. No. 3,335,690 or below the water, as known from U.S. Pat. No. 4,650,431, or in a receiving area in the keel of the vessel as known from U.S. Pat. No. 4,604,961.

Figure 1:
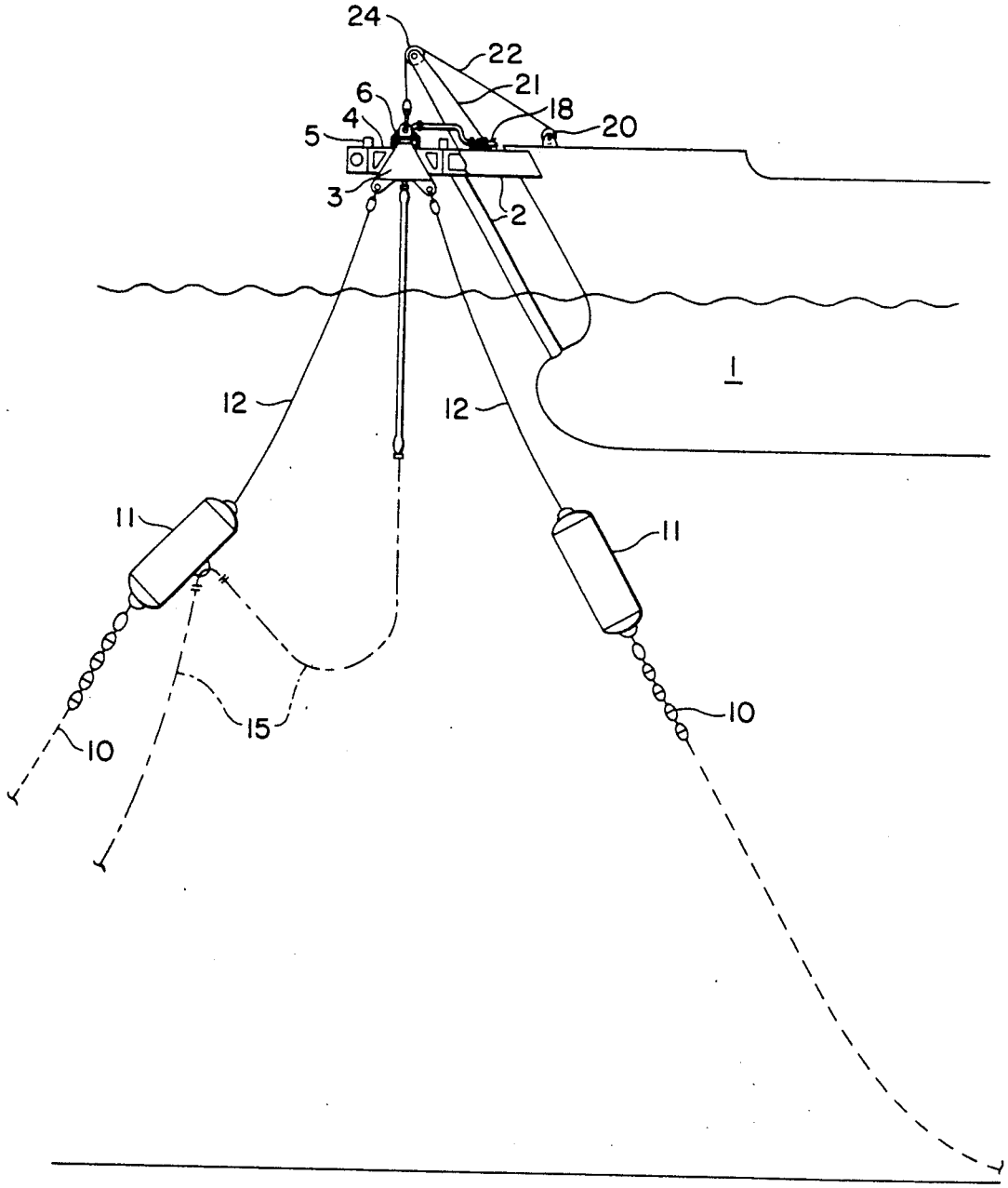
FIG. 1 is a schematic side view of the improved mooring structure of the present invention connected to the bow of a tanker.
Figure 3:
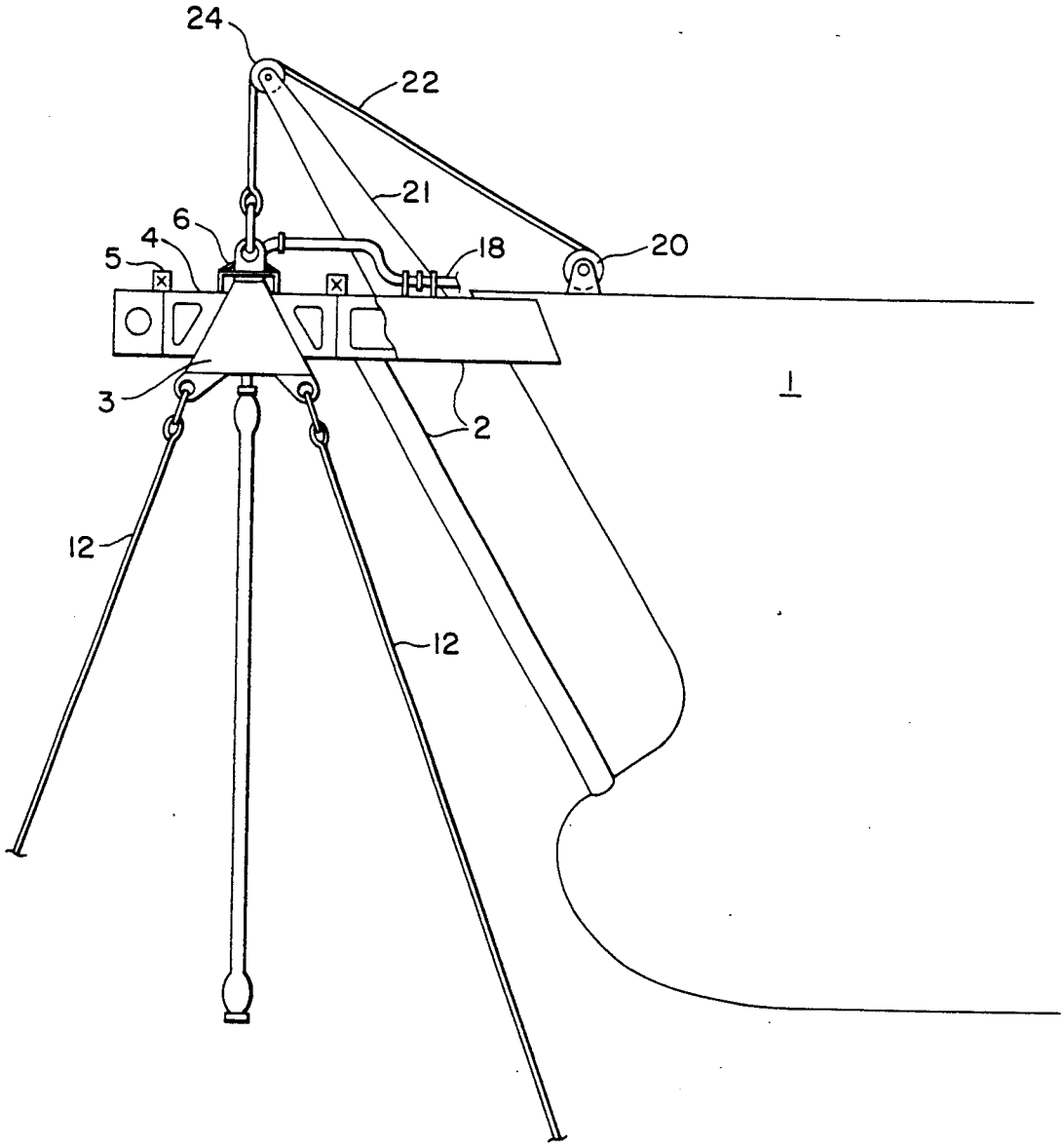
FIG. 3 is a partial side view similar to FIG. 1 but enlarged to show details with greater clarity.

The drawings illustrate schematically a side view of a mooring system according to the invention showing the basic principles: In FIG. 1 the engaged situation is shown, a vessel 1 is attached via a frame 2 to the connector body 3 which is engaged in the receiver 4, the receiver 4 is fitted to the frame 2 by a bearing arrangement 5 with vertical rotation axis to allow the vessel 1 to weathervane around the mooring system. A quick connector connects the connection body 3 to the receiver 4 and can release the vessel 1 from the mooring if the conditions make it desirable. Each mooring leg 10 is supported by a flotation tank 11 and a short chain or cable section 12 connects each flotation tank 11 with the connector body 3. A flexible pipeline conduit 15 extends through connector body 3 via the connector 6 and a suitable swivel (not shown) into the deck piping 18 of the tanker vessel 1. Conduit 15 is connected to a pipeline or a plurality of pipelines which are submerged below the water level. The connector body 3 can be pulled in the receiver 4 by winch 20, cable rope 22 running over the reel 24 fitted on support beam 2. A more detailed layout of this arrangement can be found in FIG. 3.

Figure 2:
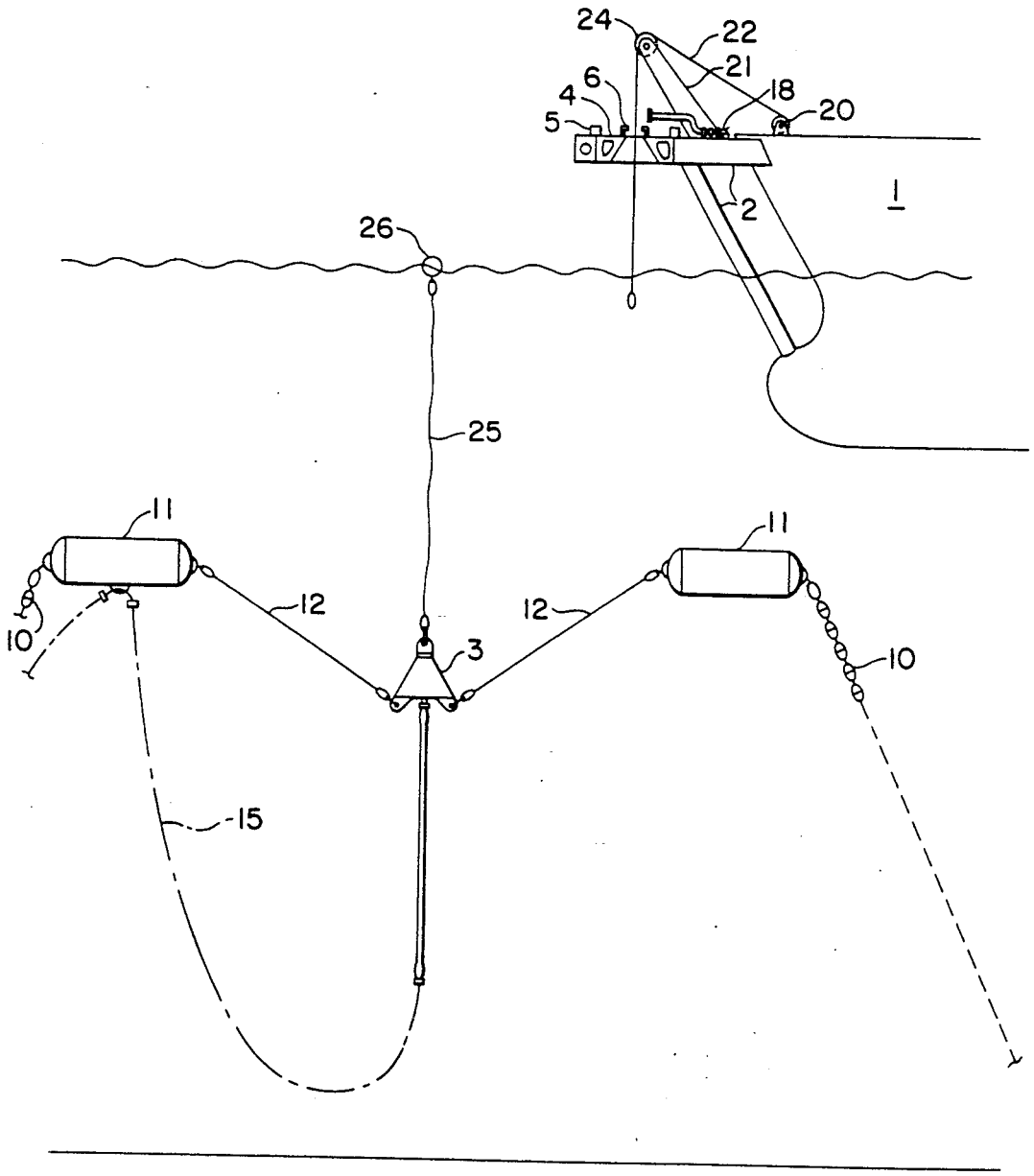
FIG. 2 is a side view of the improved mooring structure of the present invention shown in its free position with the tanker approaching for retrieval and connection to the connecting element.

FIG. 2 shows the layout in disconnected condition. The connector body 3 is now suspended from the flotation tanks 11 below the surface of water away from the direct effect of typhoon waves or ice sheets. The tanker 1 can sail away for shelter and upon return the connector body 3 can be reconnected to the vessel 1 using the winch 20 and rope 22. Depending on the weight of connector body 3 and the length of the connecting cables 12 from flotation tanks 11, it might be desirable that some additional buoyancy be provided to prevent connector body 3 from dropping to a deeper position than desired. Since retrieval line 25 is connected to connector body 3 and includes buoy 26 at its upper end so that it can be readily located and retrieved by personnel on the tanker vessel 1, the size and buoyancy of buoy 26 may be increased to provide an additional buoyancy to connector body 3 to maintain its desired position not substantially more than a safe distance below the surface of the water. This additional buoyancy is provided by the buoy 26 and not by the connector body 3 so that as connector body 3 is retrieved it is not caused to move excessively by current and wave forces of the water in the manner which is common to the buoyant connector structures of the prior art. It is generally preferred that the connections between flotation tanks 11 and connector body 3 be by cables 12 in order to save on weight but chains may be used provided that the necessary control of the maximum depth, to which connector body 3 sinks when not in use, is maintained. Additionally, if desired, flexible flowline 15 may be provided with its own buoyancy tanks rather than being supported by one of the flotation tanks 11. With the connector body 3 suspended from the flotation tanks 11 below the surface of the water it is away from any direct effect of typhoon waves or ice sheets. The tanker which is disconnected can sail away for shelter.

When it is desired to reconnect to connector body 3, the tanker vessel 1 returns and retrieves connector body 3 by first raising the buoy 26 and the retrieval line 25 by using the winch 20 and rope 22.

Figure 4:
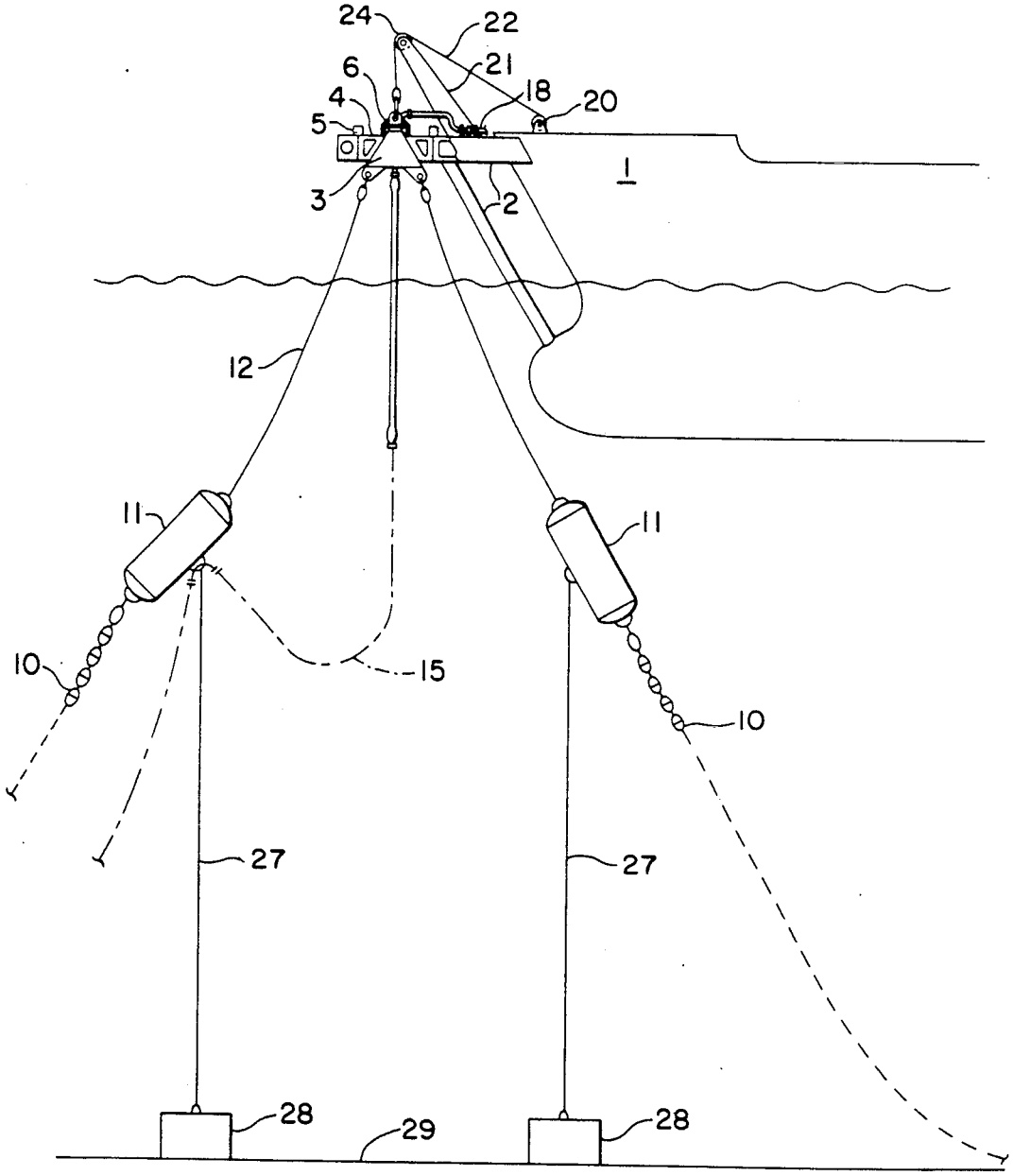
FIG. 4 is side view of a modified mooring system for the flotation tanks and showing the connector body engaged within the structure extending from the bow of the tanker.

Another way in which the level to which connector body 3 sinks when not in use is illustrated in FIG. 4. As shown, flotation tanks 11 are provided with the usual mooring legs 10 and also each includes a tension type of mooring structure which includes a fixed length mooring lines 27 connecting from mooring weights 28 on the bottom 29 of the ocean and extending up to the flotation tanks 11. In this manner the exact position of flotation tanks 11 is determined by the depth of the water at the location and by the length of the mooring lines 27. This in turn provides for the positioning of connector body 3 at the desired depth when it is not connected to the tanker 1.

Figure 5:
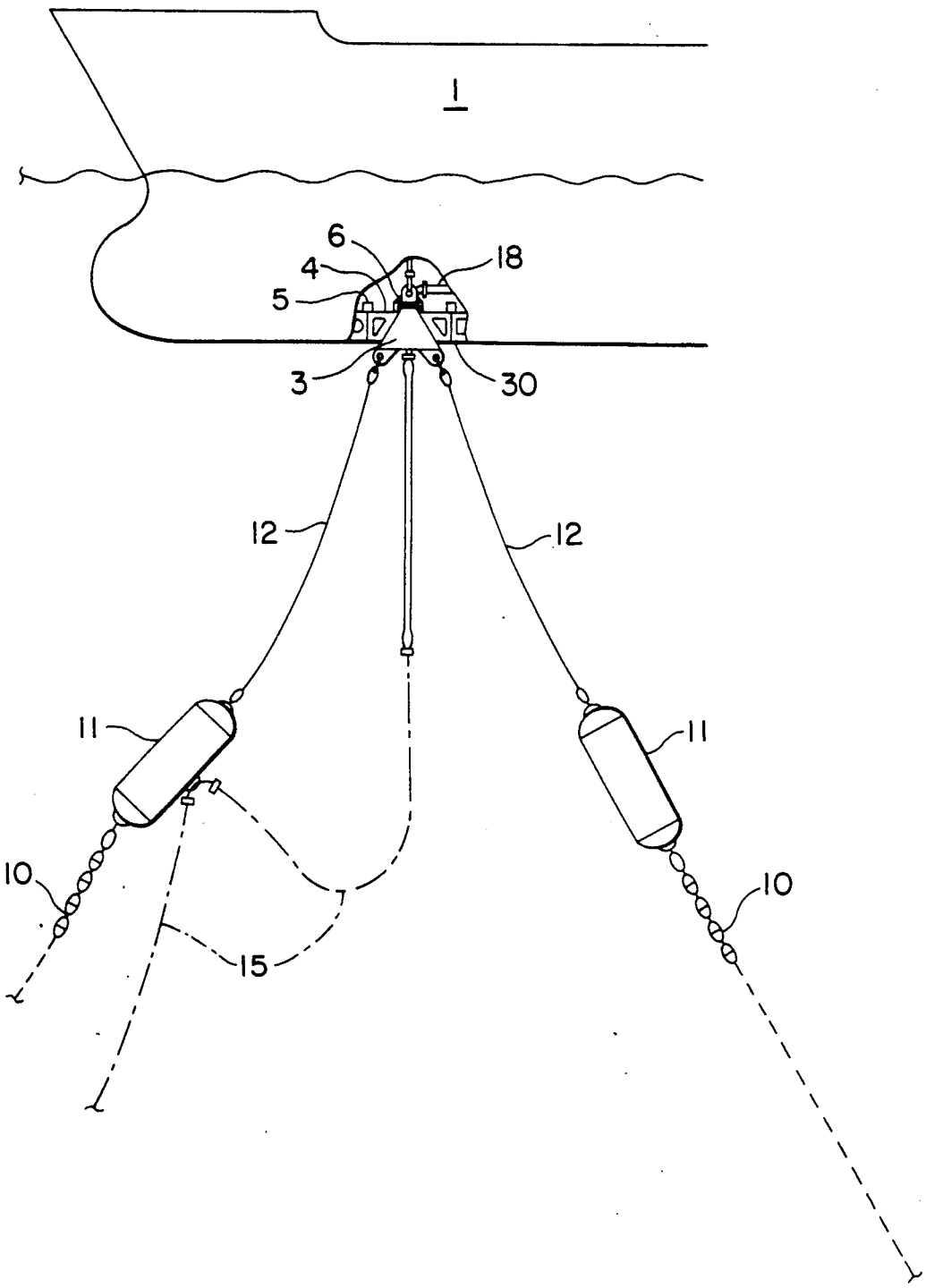
FIG. 5 is a side view of a modified form of the present invention showing the connector body engaged within its receiver which is mounted within the keel of the tanker.

The structure illustrated in FIG. 5 is similar in substantially all respects except that the recess for receiving connector element 3 is positioned extending through the keel 30 of the tanker 1. Suitable retrieving and lifting apparatus are provided as well as flowline connections for allowing transfer of fluids.

As is known, at least three mooring legs 10 and three sections 12 are used for maintaining the position of flotation tanks 11 and connector body 3. If additional mooring legs 10 and additional sections 12 are desired, they may be used.

What is claimed is:

1. A semi permanent mooring system comprising a floating unit least three (3) mooring legs for anchoring the floating unit vessel in all directions, at least three fully submerged flotation tanks to keep each leg end near the water surface, at least three short chains or cable sections, to connect the flotation tanks to a connector body, said connector body having means for rotatably securing it about a vertical axis to the floating unit, body conduits extending from below the seawater surface towards the floating unit and into a rotatable pipeline coupling for at least one pipeline, means for supporting said coupling by the floating unit, said connector body having means for quick connecting and disconnecting whereby said coupling can be connected or disconnected from the floating unit characterized in that the connector body is nonbuoyant and is kept suspended above the sea floor in the disconnected condition by the short chain sections, each being connected to its respective flotation tank, which tanks have sufficient buoyancy to support said connector body and the mooring legs.

2. A semi-permanent mooring system according to claim 1 including a flexible flowline connecting between said connector body and a subsea flowline, and floatation means separate from said flotation tanks for supporting the flexible flowline.

3. A deep water mooring system comprising a plurality of flotation tanks, mooring legs connecting from the ocean bottom to the flotation tanks for fixing the location of said flotation tanks, a nonbuoyant connector body having connections to a submerged pipeline, means supporting said connector body from said flotation tanks, and means for retrieving said connector body from the ocean to allow flow between the surface and said submerged pipeline.

4. A deepwater mooring system according to claim 3 wherein said retrieving means includes a retrieving line leading to the surface from said nonbuoyant connector body, and a buoy secured to the upper end of said retrieving line.

5. A deepwater mooring system according to claim 4 wherein said retrieving line buoy has sufficient buoyancy to assist said flotation tanks in supporting said connector body from sinking deeper in the water than desired.

6. A deepwater mooring system according to claim 3 including a vessel having means for retrieving and connecting to said connector body.

7. A deepwater mooring system according to claim 3 including a tension mooring system for each of the flotation tanks including a weight positioned on the bottom, and a tension line extending from the weight to the flotation tank to maintain the flotation tanks at their desired position in the water and thereby control the maximum depth to which the connector body sinks when not in its retrieved position with respect to a vessel.

* * * * *